US007323086B1

(12) United States Patent
Sekiya

(10) Patent No.: US 7,323,086 B1
(45) **Date of Patent: *Jan. 29, 2008**

(54) POLLUTION PREVENTION METHOD FOR CANVAS USED IN PAPER MACHINE

(75) Inventor: Kunio Sekiya, Tokyo (JP)

(73) Assignee: Maintech Co., Ltd., Nagasaki, Toshima-Ku, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/486,483

(22) PCT Filed: Sep. 14, 1999

(86) PCT No.: PCT/JP99/05023

§ 371 (c)(1),
(2), (4) Date: Mar. 23, 2001

(87) PCT Pub. No.: WO00/19009

PCT Pub. Date: Jun. 4, 2000

(30) Foreign Application Priority Data

Sep. 25, 1998 (JP) ..... 10-288945

(51) Int. Cl.
*D21H 1/32* (2006.01)

(52) U.S. Cl. ..... 162/199; 162/263; 162/111; 162/112; 162/DIG. 4

(58) Field of Classification Search ..... 162/199, 162/263, 111, 112, DIG. 4, 164.4, 158
See application file for complete search history.

(56) References Cited

U.S. PATENT DOCUMENTS 3,014,832 A 12/1961 Donnelly et al.
4,861,429 A 8/1989 Barnett et al. ..... 162/199
5,073,235 A * 12/1991 Trokhan ..... 162/199
5,863,385 A 1/1999 Siebott et al.
6,858,113 B1 * 2/2005 Sekiya ..... 162/199

FOREIGN PATENT DOCUMENTS

AU 590096 B2 12/1996
DE 19519268 C1 1/1997

(Continued)

OTHER PUBLICATIONS

The International Search report for PCT/JP99/05023 Dec. 14, 1999.

*Primary Examiner*—Mark Halpern
(74) *Attorney, Agent, or Firm*—Potter Anderson & Corroon LLP

(57) ABSTRACT

The invention provides a method of preventing contamination of a canvas of a paper machine, whereby antifouling effect on the canvas can always be maintained and precise drying efficiency is ensured. With the method of preventing contamination of the canvas for pressing a paper strip against the surface of drum-dryers used for drying the paper strip in a paper machine, a predetermined amount of a surface treatment agent P is continuously supplied to the surface of the canvases C2, C3, facing the paper strip, in a stage of operation prior to the paper strip being pressed into contact with the canvases C2, C3 as well as the drum-dryers C1, while the paper strip is being fed by operation of the paper machine.

2 Claims, 9 Drawing Sheets
(3 of 9 Drawing Sheet(s) Filed in Color)

FOREIGN PATENT DOCUMENTS

| | | | |
|---|---|---|---|
| EP | 0828889 | B1 | 3/1998 |
| GB | 2284833 | A | 6/1995 |
| JP | 57-171790 | | 10/1982 |
| JP | 60134092 | | 12/1986 |
| JP | 6175892 | | 10/1987 |
| JP | 3-69690 | | 3/1989 |
| JP | 4-130190 | | 5/1992 |
| JP | 6-280181 | | 10/1994 |
| JP | 7-292382 | | 11/1995 |
| JP | 7-292591 | | 11/1995 |
| WO | WO96/38628 | | 12/1996 |
| WO | WO00/19009 | | 4/2000 |

* cited by examiner

POLLUTION PREVENTION METHOD FOR CANVAS USED IN PAPER MACHINE

TECHNICAL FIELD

The present invention relates to a method of preventing contamination of a canvas used in conjunction with dryers of a paper machine, and more particularly, to a method of preventing contamination of a canvas used in conjunction with dryers of a paper machine (pollution prevention method for canvas used in paper machine).

BACKGROUND OF TECHNOLOGY

Paper has recently been put to numerous applications in an extensive range, and paper stock having functions never heard before has been developed up to date.

As a result, paper produced by a paper machine has come to be diversified, and is numerous in type. As paper produced by a paper machine has to go through a drying process before turned into a product, the drying process occupies a very important position from the technical viewpoint.

The paper machine is equipped with a plurality of dryers used for drying, and the dryers have a construction such that a heating medium such as steam and the like are contained therein for heating from inside of the dryers.

Moist paper undried as yet is fed continuously to the dryers of the paper machine.

It is a canvas as it is called that plays a role of pressing hard wet paper into contact with the surface of the dryers.

The wet paper gives off moisture contained therein by absorbing heat from the surface of the dryers when pressed by the canvas.

For this reason, the canvas is normally formed of material flexible and porous, for example, woven fabric, felt (unwoven fabric), knitted fabric, and the like.

An enlarged view of the surface of the canvas shows that a multitude of fine pores (so-called eyes of the canvas) are formed on the surface thereof between threads making up the canvas.

Moisture contained in the wet paper is heated by the dryers at high temperatures, and dispersed through the eyes of the canvas.

Incidentally, paper contains various substances, for example, pitch/tar component contained in pulp stock itself, hotmelt, ink and microfibers originating from waste paper stock, various additive chemicals for reinforcing strength and whiteness of paper, and inclusions (foreign matter) such as paint, and so forth. Such inclusions having tackiness will be deposited on the surface of the canvas when the wet paper is pressed hard against the surface of the dryers by the canvas, turning into contaminant (the source of contamination).

That is, the inclusions contained in paper undergo denaturization due to the effect of pressure and heat, and adhere to the surface of the canvas, causing the eyes of the canvas to be clogged.

There has since been a shift in raw material for the canvas from natural fiber to synthetic fiber with the result that the canvas has come to have a longer service life due to longer durability thereof.

The longer service life means that there will be an increase in accumulation of the contaminant to that extent.

Accordingly, after the operation of the paper machine for a long duration, there will occur fairly often a phenomenon wherein the eyes of the canvas get clogged with the contaminant.

In recent times, addition of, for example, polyacrylic resin to paper has been in practice curing a paper making process in order to reinforce paper strength and to improve a product yield, and particularly, in the case of an additive of a cation type being used, the additive is easily transferred to the canvas, and adheres thereto, causing the eyes of the canvas to be clogged.

Once the clogging of the eyes of the canvas occurs, air permeability of the canvas deteriorates drastically, resulting in poor drying efficiency of paper.

More specifically, sufficient moisture is normally emitted from the wet paper through the eyes of the canvas when the wet paper is pressed hard between the dryers and the canvas, however, once the clogging of the eyes of the canvas occurs, emitted moisture can not find its way out. In such a state, the dig efficiency deteriorates significantly.

Parts of the contaminant accumulated on the canvas are then transferred from the surface of the canvas to a portion of a paper strip, newly fed, resulting in contamination of product paper.

The contaminant having strong tackiness is also accumulated on an out-roll serving as a guide-roll for the canvas and turned into large lumps.

When parts of such lumps are peeled off, and adhere to the surface of the wet paper, the wet paper will be provided with additional tensile force due to the effect of the tackiness of the contaminant at the time of the dryers coming in contact with the wet paper, creating a cause for breaks of the wet paper.

For solving such problems as described above, countermeasures have been adopted wherein periodical cleanups of the canvas are carried out frequently or an interval between replacements of the canvas is rendered shorter. These countermeasures, however, have turned out to be expensive in terms of time and cost.

Accordingly, there has been developed a method of preventing contamination of the canvas by applying surface treatment to the canvas.

That is, it is a method whereby the surface of the canvas is treated with a water-repellent or of repellent resin, for example, ethylene resin tetrafluoride.

Such treatment, however, will result in formation of regions where the eyes of the canvas are partially clogged, causing the drying efficiency to be deteriorated.

Furthermore, such an anti-fouling treatment will be effective only in the initial stage of operation of the paper machine, and the effect of the treatment will decrease in several days (for example, in 6 to 6 days after the treatment is applied), so that a treated canvas then will not be different at all from the canvas untreated.

As described in the foregoing, the paper machine has been faced with major technical problems in that various inclusions contained in the wet paper are adhered to the canvas, and accumulated thereon along with the operation of the paper machine, whereupon the eyes of the canvas are clogged, thereby biting evaporation of moisture, and resulting in poor drying efficiency, and also in that the contaminant accumulated on the canvas as well as the out-roll causes parts of the paper strip, newly fed, to be contaminated as well or create a cause for breaks of the paper strip being processed.

DISCLOSURE OF THE INVENTION

The invention has been developed in an attempt to solve various problems described in the foregoing.

It is therefore an object of the invention to provide a method of preventing contamination of a canvas used in a paper machine, capable of not only maintaining the anti-fouling effect thereof at all times but also ensuring precise drying efficiency thereof.

To this end, the inventors have carried out intense studies on the subjects described, and discovered as a result that silicone can be caused to adhere to the surface of the canvas to an extent not to cause the eyes of the canvas to be clogged by continuously supplying silicone oil to the canvas without interruption. The inventors have succeeded in the development of the present invention on the basis of this fact.

That is, the first aspect of the invention provides a method of preventing contamination of a canvas for pressing a paper strip against the surface of drum-dryers used for drying the paper strip in a paper machine, whereby a predetermined amount of a surface treatment agent is continuously supplied to the surface of the canvas, facing the paper strip, in a stage of operation prior to the paper strip being pressed into contact with the canvas as well as the drum-dryers, while the paper strip is being fed by operation of the paper machine.

The second aspect of the invention provides method of preventing contamination of the canvas, wherein the surface treatment agent in the first aspect of the invention contains a silicon oil.

The third aspect of the invention provides a method of preventing contamination of the canvas, wherein a silicon oil emulsified with a surfactant in the first aspect of the invention is used for the surface treatment agent.

The fourth aspect of the invention provides s method of preventing contamination of the canvas, wherein the surface treatment agent in the second or third aspect of the invention is diluted with water before being put to use.

The fifth aspect of the invention provides a method of preventing contamination of the canvas, wherein the surface treatment agent in the second or third aspect of the invention is diluted with water heated to a temperature in the range of 50 to 80° C. immediately before spraying is put to use.

The sixth aspect of the invention provides a method of preventing contamination of a canvas for pressing a paper strip against the surface of drum-dryers used for drying the paper strip in a paper machine, whereby a silicone oil is continuously supplied at a spray rate of 0.1 to 200 mg/m$^2$ per min to the surface of the canvas, facing the paper strip, in a stage of operation prior to the paper strip being pressed into contact with the canvas as well as the drum-dryers, while the paper strip is being fed by operation of the paper machine.

The seventh aspect of the invention provides a method of preventing contamination of a canvas for pressing a paper strip against the surface of drum-dryers used for drying the paper strip in a paper machine, whereby a predetermined amount of a surface treatment agent is continuously supplied to the surface of canvas rolls for guiding the canvas, in a stage of operation prior to the paper strip being pressed into contact with the canvas as well as the drum-dryers, while the paper strip is being fed by operation of the paper machine.

The eighth aspect of the invention provides a method of preventing contamination of the canvas, wherein the surface treatment agent in the seventh aspect of the invention contains a silicon oil.

The ninth aspect of the invention provides a method of preventing contamination of the canvas, wherein a silicon oil emulsified with a surfactant is used for the surface treatment agent in the seventh aspect of the invention.

The tenth aspect of the invention provides a method of preventing contamination of the canvas, wherein the surface treatment agent in the eighth or ninth aspect of the invention is diluted with water before being put to use.

The eleventh aspect of the invention provides a method of preventing contamination of a canvas for pressing a paper strip against the surface of drum-dryers used for drying the paper strip in a paper machine, whereby a silicone oil is continuously supplied at a spray rate of 0.1 to 200 mg/m$^2$ per min to the surface of canvas rolls for guiding the canvas, in a stage of operation prior to the paper strip being pressed into contact with the canvas as well as the drum-dryers, while the paper strip is being fed by operation of the paper machine.

The twelfth aspect of the invention provides a method of preventing contamination of a canvas for pressing a paper strip against the surface of drum-dryers used for drying the paper strip in a paper machine, said method comprising the following steps 1) to 4):

1) the silicone oil supply step for supplying a silicone oil to the surface of the canvas;

2) the silicone oil permeation and adhesion step for causing the silicone oil to permeate through the canvas and adhere to the surface thereof under heat and pressure;

3) the silicone oil transfer step for pressing a paper strip against the canvas, causing the silicone oil to be transferred to the paper strip; and 4) the silicone oil replenishment step for replenishing the silicone oil depleted after transferred from the canvas.

The thirteenth aspect of the invention provides a method of preventing contamination of a canvas for pressing a paper strip against the surface of drum-dryers used for drying the paper strip in a paper machine, said method comprising the following steps 1) to 5):

1) the silicone oil supply step for supplying a silicone oil to the surface of an out-roll;

2) the silicone oil shifting step for shifting the silicone oil from the surface of the out-roll to the canvas;

3) the silicone oil permeation and adhesion step for causing the silicone oil to permeate through the canvas and adhere to the surface thereof under heat and pressure;

4) the silicone oil transfer step for pressing a paper strip against the canvas, causing the silicone oil to be transferred to the paper strip; and 5) the silicone oil replenishment step for replenishing the silicone oil depleted after transferred from the canvas.

Operation

By continuously supplying the silicone oil by a predetermined amount onto the surface of the canvas, the silicone oil is adhered to the surface of the canvas.

As the canvas and the paper strip are pressed into contact with each other, and subjected to heating by the dryers, the silicone oil permeates through the canvas and is adhered thereto.

On one hand, the silicone oil is gradually transferred to the paper strip and depleted but, on the other hand, since the canvas is continuously supplied with the silicone oil without interruption the canvas remains in a condition with newly supplied silicone adhered thereto after depleted portions of the silicone oil is replenished.

Accordingly, various inclusions contained in the paper strip are prevented from adhering to the surface of the canvas.

BRIEF DESCRIPTION OF DRAWINGS

The patent or application file contains at least one drawing/photograph executed in color. Copies of this patent or patent application publication with color drawing(s)/photograph(s) will be provided by the Office upon request and payment of the necessary fee.

BEST MODE FOR CARRYING OUT THE INVENTION

Preferred embodiments of the present invention are described hereinafter with reference to the accompanying drawings.

First, an example of a paper machine to which the invention is applied is described.

Figure 1:
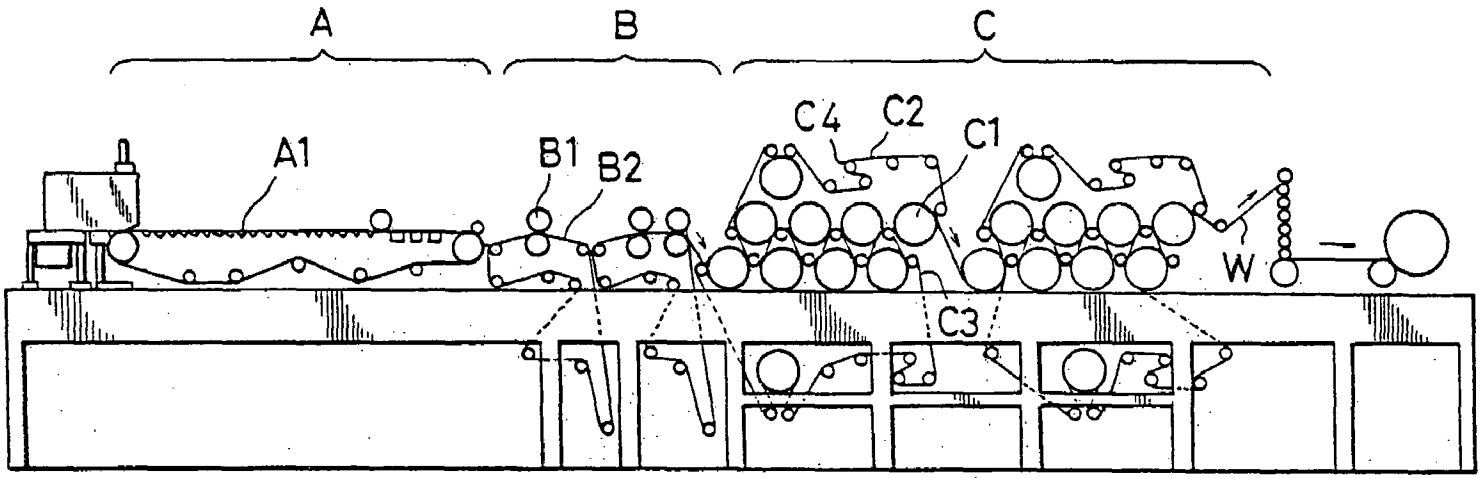
FIG. 1 is a schematic illustration showing a paper machine in whole, provided with a dry part having multiple drum-dryers.

FIG. 1 shows a paper machine equipped with multiple drum-dryers, comprising broadly a wire part A, a press part B, and a dry part C.

Operation of the paper machine is briefly described as follows.

In the wire part A, feed stock (pulp and so forth) is fed from a flow spreader head box onto a Fourdrinier wire table A1 evenly so as to be formed into a sheet-like shape.

A paper strip W formed in a sheet-like shape will have the moisture thereof reduced to the order of 80% while passing on the Fourdrinier wire table A1, and then be transferred to the press part B.

In the press part B, the paper strip W is squeezed from both above and below by a pressing roller B1, an endless belt B2, and so forth.

The paper strip W will have the moisture thereof reduced to the order of 50% while passing through the press part B, and thereafter, be transferred to the dry part (dig area) C.

In the dry part C, the greater part of humidity of the paper strip W will be given off, and the moisture thereof will be reduced to the order of 10%.

More specifically, the dry part C is provided with heated drum-dryers C1, canvases C2, C3 for pressing the paper strip against the drum-dryers, and canvas rollers C4 and so forth for guiding the canvases, so as to cause the paper strip W to give off the moisture thereof by the effect of heat.

Figure 2:
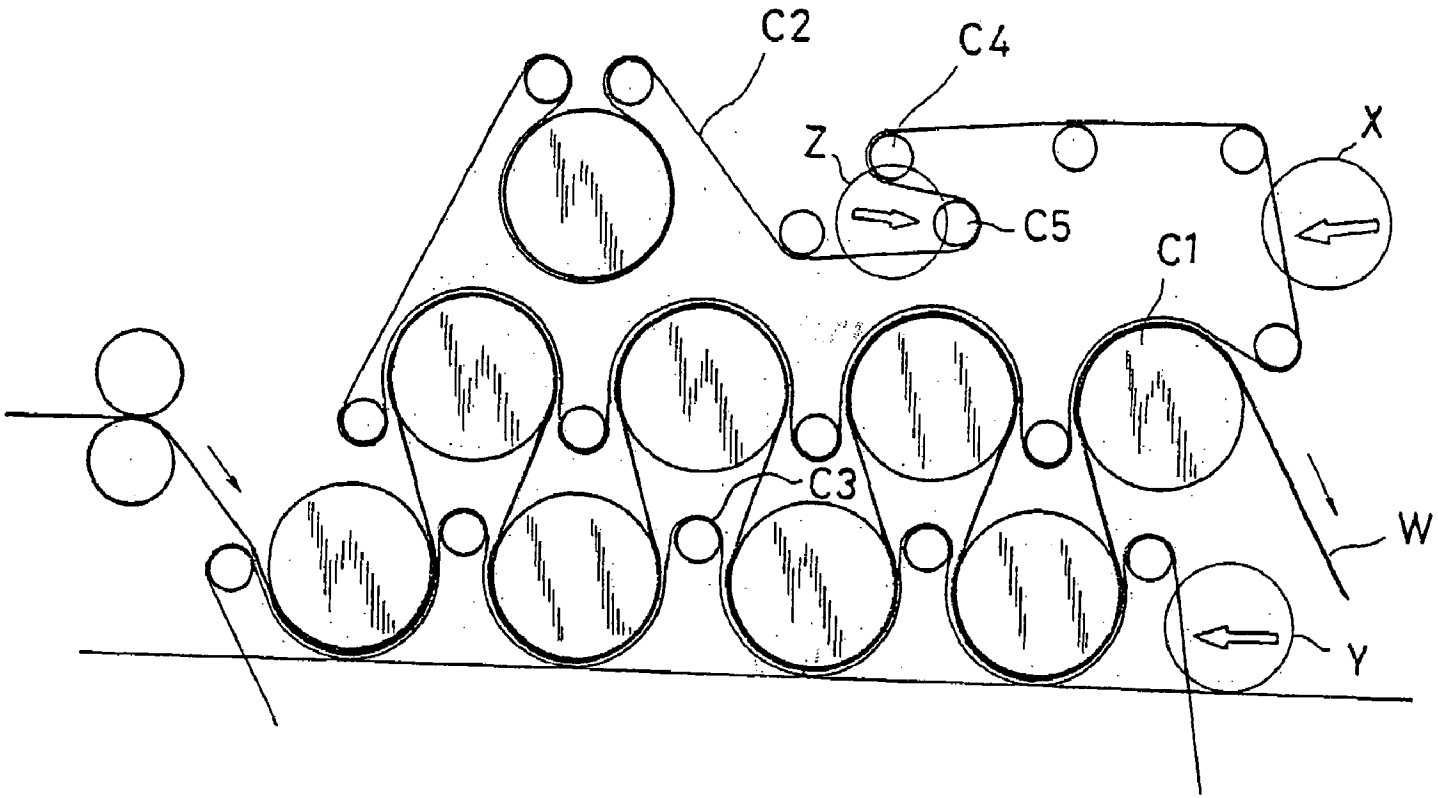
FIG. 2 is an enlarged view of the dry part shown in FIG. 1.

The paper machine shown in FIG. 1 comprises two dry parts, each consisting of a group of drum-dryers, and FIG. 2 is an enlarged view of one of the dry parts.

The dry part C has a construction such that the canvases C2, C3, disposed on the upper level and the lower level respectively, are caused to run by a plurality of the canvas rollers along paths in a given closed loop, respectively, so as to be pressed into contact with a plurality of the drum dryers C1.

The drum-dryers C1 in use are of a multiple type, and the plurality thereof are juxtaposed on the upper level as well as the lower level respectively.

As described above, the canvases C2 and C3 act to press the paper strip into contact with the respective drum-dryers, and run between the respective canvas rolls C4 in sequence.

As is evident from the figure, the inner canvas rolls C4 are disposed on the inner side of the canvases C2, C3, and out-rolls C5 are disposed on the outer side thereof.

The out-rolls are normally set so as to be freely movable, enabling tension of the respective canvases in whole to be adjusted.

Now, in the dry part C of the paper machine described above, the paper strip W (in fact, wet paper) is fed and transferred along a given path, while being pressed in contact with both the canvases and the drum-dryers.

Drying of the paper strip W gradually proceeds as the paper strip W is pressed between the canvas and the drum-dryers at the upper level and between the canvas and drum-dryers at the lower level, respectively.

The object of the invention is attained by spraying a surface treatment agent containing a silicone oil onto the surface of the canvases, facing the paper strip W, in the dry part described above.

Figure 3:
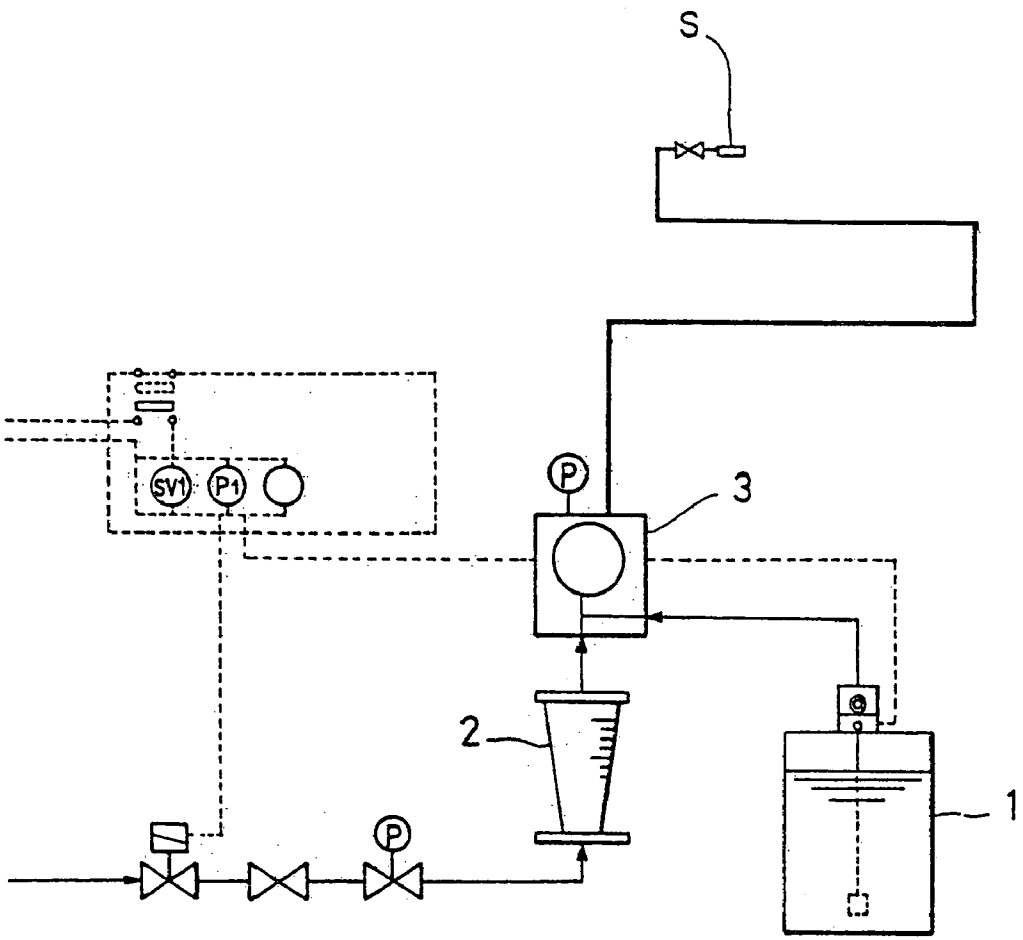
FIG. 3 is a schematic illustration showing a chemical spray unit used for spraying a surface treatment agent.

Now, for guidance, a chemical spray unit used for spraying a chemical, that is, the surface treatment agent, is shown in FIG. 3.

With the chemical spray unit, the surface treatment agent delivered from a chemical tank 1 is sprayed to the surface of the canvas through a spray nozzle S.

Water may be taken in via a flow meter 2 as necessary, and mixed with the surface treatment agent through a mixer 3, so that water can be sprayed simultaneously through the spray nozzle S.

A method of spraying onto the canvas may be selected in various ways by changing the type of the spray nozzle.

Figure 4:
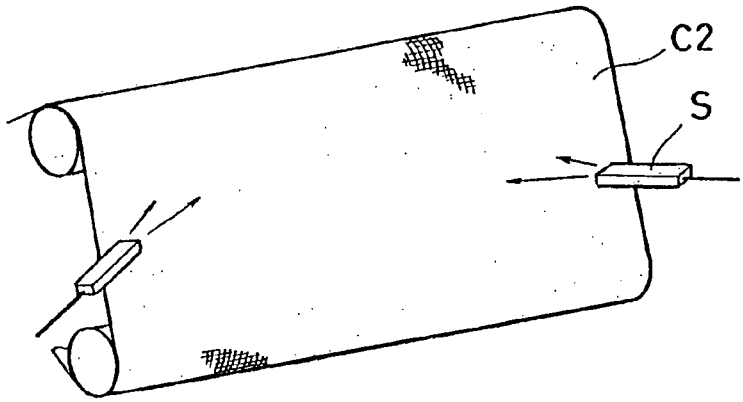
FIG. 4 is a view showing a state of spraying the surface treatment agent onto a canvas of the paper machine through fixed type spray nozzles of the chemical spray unit.
Figure 5:
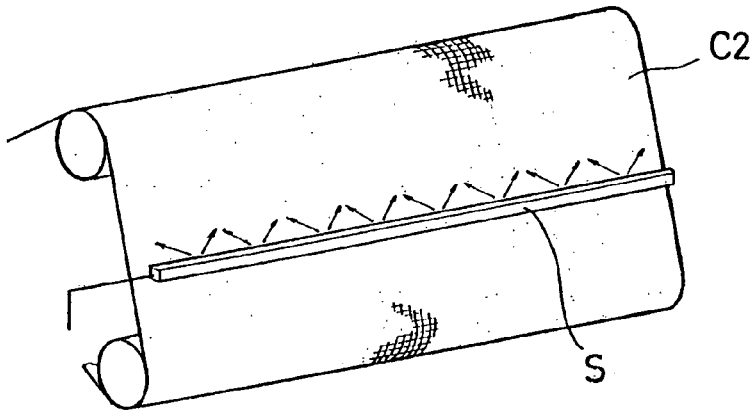
FIG. 5 is a view showing a state of spraying the surface treatment agent onto a canvas of the paper machine through spray nozzles disposed lengthwise.
Figure 6:
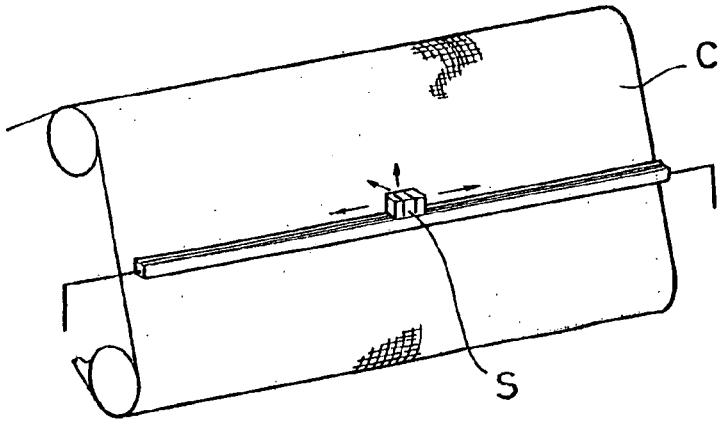
FIG. 6 is a view showing a state of spraying the surface treatment agent onto a canvas of the paper machine through a movable type spray nozzle.

FIGS. 4 to 6 are schematic illustrations showing various states in which the surface treatment agent is sprayed.

FIG. 4 is a schematic illustration showing a spraying state wherein a silicone oil is sprayed onto the surface of the canvas through fixed type spray nozzles of the chemical spray unit, FIG. 5 a schematic illustration showing same in the case of using the chemical spray unit provided with spray nozzles disposed lengthwise, and FIG. 6 a schematic illustration showing same in the case of using the chemical spray unit provided with a movable spray nozzle.

For prevention of contamination of the canvases, the surface treatment agent is sprayed onto the surface of the canvases through the spray nozzles set as shown in FIGS. 4 to 6, respectively, at the positions indicated by the letters X, Y, and so forth, respectively, in FIG. 2.

The surface treatment agent used in carrying out the invention is composed mainly of silicone oil.

In this case, methylphenyl silicone oil, diethyl silicone oil, denatured amino silicone oil, denatured epoxy silicone oil, denatured higher fatty acid silicone oil, and so forth are adopted for the silicone oil (silicone-based oil).

The silicone oil (silicone-based oil), that is, the surface treatment agent, may preferably be emulsified by adding a surfactant thereto so as to lower viscosity thereof as well as to improve dispersion characteristic during spraying.

The surfactant used for emulsification of the silicone oil may preferably be added in percentage corresponding to 15 to 70 wt. % of the silicone oil, and the surface treatment agent is normally prepared by diluting the silicone oil with water 4 to 15 times as much.

Needless to say, other additives may be further added thereto as necessary.

There may be cases where the surface treatment agent is further diluted with water by a factor of 100 to 3000 in order to spray the surface treatment agent in a wider range on the canvases simultaneously.

Further, water used for dilution may preferably be heated to a temperature in the range of 50 to 80λ C. to minimize a risk of the nozzles getting clogged with scum and slime.

Naturally, in this case, the surface treatment agent too is to be heated to a substantially equivalent temperature.

Now, a series of steps for supplying the canvases with the surface treatment agent are described hereinafter.

As shown in FIGS. 4 to 6, the surface treatment agent containing the silicone oil is continuously supplied onto the surface of the canvases (a silicone oil supply step).

As the canvases are pressed into contact with the drum-dryers via the paper strip, the silicone oil supplied to the canvases is heated by conduction heat of the drum-dryers, and permeates through the canvases (a silicone oil permeation and adhesion step).

Since the silicone oil is supplied by a small batch as described hereinafter, clogging of the eyes of the canvases does not occur.

While the paper machine is in continuous operation, the silicone oil makes ingress into the interior of the canvases from the surface thereof, and is closely adhered thereto.

Meanwhile, the silicone oil adhered to the surface of the canvases is continuously transferred by a predetermined amount to the paper strip as the canvases continue to be pressed against the paper strip (a silicone oil transfer step).

Consequently, the silicone oil adhered to the canvases will be gradually depleted (wasted).

On the other hand, as constant supply of the silicone oil to the canvases still continues, any depleted portion of the silicone oil can be replenished quickly (a silicone oil replenishment step).

Such depletion of the silicone oil and replenishment thereof as described above are not phenomena occurring independently from each other but operations implemented simultaneously in conjunction with each other.

In marked contrast with a conventional method wherein canvases to which anti-fouling treatment has been applied beforehand are in use, there will not occur a gradual decrease in the effect of the anti-fouling treatment in this case according as the canvases are used over time.

Accordingly, the surface of the canvases is always in a condition where a suitable amount of the silicone oil contained in the surface treatment agent is present, enabling the canvases to withstand continuous operation satisfactorily.

Figure 7:
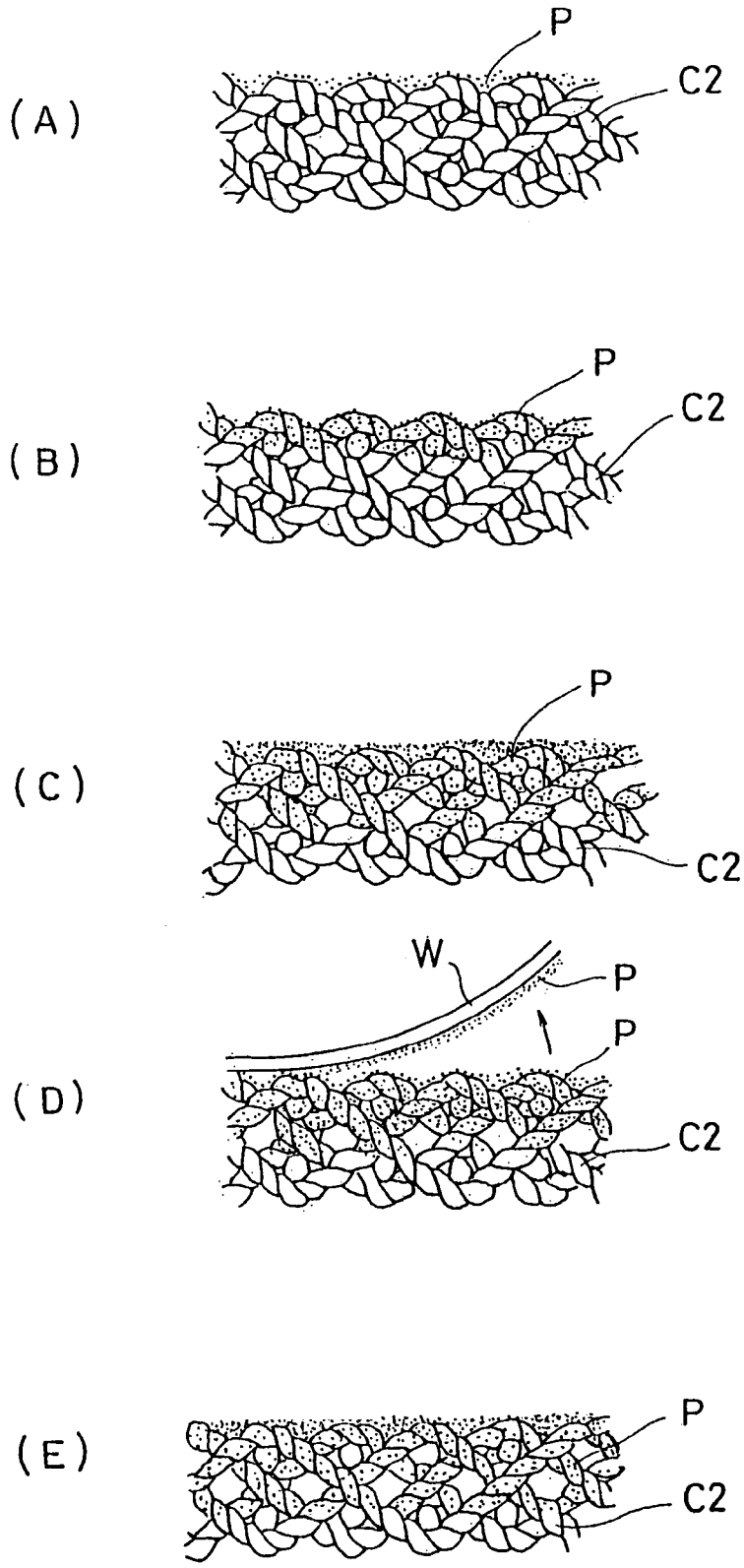
FIG. 7 is a schematic illustration showing the principle of silicone oil adhering to the surface of a canvas.

FIG. 7 is a schematic illustration showing how the surface of the canvases is treated with the surface treatment agent containing the silicone oil. The process of such treatment comprises the following steps.

That is, in the silicone oil supply step 1), the silicone oil P is adhered to the surface of the canvas C2 (A).

Next, in the silicone oil permeation and adhesion step 2), the silicone oil P is heated up by the drum-dryers, and makes ingress into the interior of the canvas C2 (B).

In the subsequent step 3), as supply of the silicone oil continues, the silicone oil P makes further ingress deeper into the interior of the canvas C2 (C).

In the silicone oil transfer step 4), the silicone oil P is transferred to the paper strip W, undergoing natural depletion on the surface of the canvas C2 (D).

Then, in the silicone oil replenishment step 5), a portion of the silicone oil, depleted due to transfer thereof to the paper strip W, is replenished quickly as necessary by supply of a new batch of the silicone oil (E).

As described in the foregoing, in the initial stage of the operation of the paper machine, the steps 1) to 3) described above are carried out by continuously supplying a new region of the surface of the canvas in motion with the surface treatment agent containing the silicone oil.

Subsequently, the steps 4) to 5) described above are carried out by continuing supply of the silicone oil.

But, in fact, the steps 4) and 5) are indistinguishable from each other as described in the foregoing, and implemented simultaneously.

Thus, respective operations described above are caused to come into play when the process of treatment goes through each of the four steps, that is, the silicone oil supply step, the silicone oil permeation and adhesion step, the silicone oil transfer step, and the silicone oil replenishment step, thereby developing antifouling effects on the canvases.

Now, an important point in carrying out the invention is an amount of the silicone oil to be supplied to the canvases at a time.

The reason for this is that an excessive supply rate of the silicone oil will result in clogging of the eyes of the canvases, deteriorating drying efficiency. On the other hand, with an insufficient supply rate of the silicone oil, a depleted amount of the silicone oil on the canvases can not be replenished constantly.

Accordingly, the supply (spraying) of the silicone oil needs to be made so as to meet these two requirements.

A supply rate of the silicone oil somewhat varies depending on the type of the canvas and quality of the paper strip, however, it is normally 0.1 to 200 mg/m2 per min, preferably 1 to 100 mg/m2 per min.

If the supply rate is less than 0.1 mg/m2 per min, sufficient permeation of the silicone oil into the canvases does not occur while if the supply rate exceeds 200 mg/m2 per mix, dripping of the surface treatment agent containing the silicone oil occurs, causing clogging of the eyes of the canvases, oil stain on paper, or contamination of peripheral equipment.

Next, tests (embodiment 1 through embodiment 3) on the method of preventing contamination of the canvas according to the invention were conducted by varying the supply rate of the silicone oil, and the results thereof are described hereinafter.

Other tests (comparative examples) were also conducted using a canvas with pretreatment applied thereto, and the result thereof are described as well.

EMBODIMENT 1

With the multiple drum-dryer type paper machine (manufactured by K. K. kobayasi Seisakusho) shown FIG. 1, a test was carried out for a month, wherein a surface treatment agent was continuously sprayed onto the surface of a canvas through the nozzle of the chemical spray unit shown in FIG. 6, and thereafter, the condition of the surface of the canvas at that point in time was observed.

Also, the quality of paper (liner) produced during the test was inspected. (surface treatment agent used)

The surface treatment agent used in the test was an emulsified aqueous solution prepared by diluting a mixture composed of the silicone oil and a surfactant mixed at wt. ratio of 10:5 with water 6 times as much as the silicone oil (specific gravity at about 1.0 g/cc).

(Spray Amount)

6 cc /min

In this case, the size of an area on the surface of the canvas against which a paper strip is pressed was 50 $m^2$ and a supply rate of the silicone oil for a unit area per a unit time was:

$$6\ \text{cc/min} \times 1.0\ \text{g/cc} \div 6 \div 50\ \text{m}^2 = 0.02\ \text{g/m}^2\ \text{per min} = 20\ \text{mg/m}^2\ \text{per min.}$$

(Result)

Figure 11:
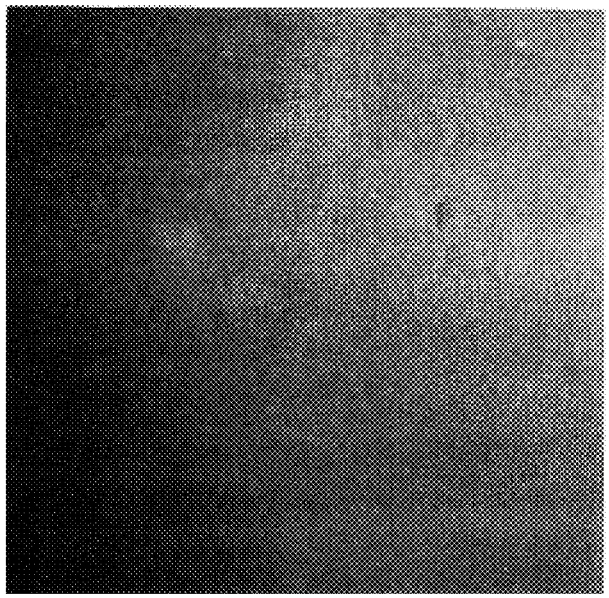
FIG. 11 is a photograph showing the result of a first embodiment of the invention.

The result showed that clogging of the eyes of the canvas was hardly observed (refer to FIG. 11), and any stain on paper, caused by the contaminant and the silicone oil contained in the surface treatment agent, was not observed at all. Further, breaks of paper occurred about 5 times in the dry part during the test, representing a marked reduction in frequency of occurrence of the breaks in comparison with that experienced before application of the technology of the invention, which was 25 times per month.

EMBODIMENT 2

With the multiple drum-dryer type paper machine (manufactured by Mitsubishi Heavy Industries Co., Ltd) shown in FIG. 1, a test was carried out for a month, wherein a surface treatment agent was continuously sprayed onto the surface of the canvas through the nozzle of the chemical spray unit shown in FIG. 5, and thereafter, the surface condition of an outroll for the canvas at that point in time was observed.

Also, the quality of paper (corrugating medium material) produced during the test was inspected.

(Surface Treatment Agent Used)

The surface treatment agent used in the test was an emulsified aqueous solution prepared by diluting the surface treatment agent used in the embodiment 1 with water heated to 60° C. in quantity 200 times as much (specific gravity at about 1.0 g/cc).

(Spray Amount)

2400 cc/min

In this case, the size of an area of the surface of the canvas against which a paper strip is pressed was 160 $m^2$ and a supply rate of the silicone oil for a unit area per a unit time was:

$$2400\ \text{cc/min} \times 1.0\ \text{g/cc} \div 200 \div 6 \div 160\ \text{m}^2 - 0.0125\ \text{g/m}^2\ \text{per min} = 12.5\ \text{mg/m}^2\ \text{per min.}$$

(Result)

Figure 12:
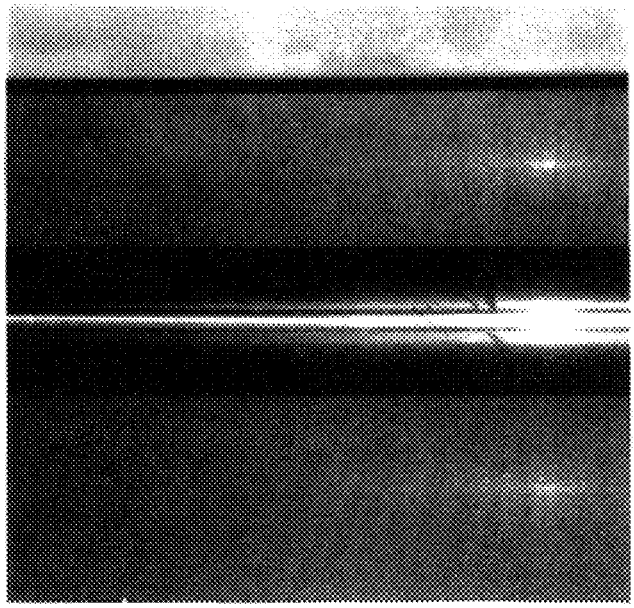
FIG. 12 is a photograph showing the result of a second embodiment of the invention.

The result showed that no accumulation of the contaminant was observed on the surface of the outroll at all (refer to FIG. 12), and any stain on paper, caused by the contaminant and the silicone oil, was not observed at all either.

Further, breaks of paper occurred 8 times in the dry part during the test, representing a marked reduction in frequency of occurrence of the breaks in comparison with that experienced before application of the technology of the invention, which was 40 times per month.

EMBODIMENT 3

With the multiple drum-dryer type paper machine (manufactured by K. K. Kobayashi Seisakusho) shown in FIG. 1, a test was carried out for a month, wherein a surface treatment agent was continuously sprayed onto the surface of the canvas through the nozzle of the chemical spray unit shown in FIG. 6, and thereafter, the condition of the surface of the canvas at that point in time was observed.

Also, the quality of paper (low grade printing paper) produced during the test was inspected.

(Surface Treatment Agent Used)

The surface treatment agent used in the test was an emulsified aqueous solution prepared by diluting a mixture composed of the silicon oil and the surfactant mixed at wt. ratio of 10:8 with water 14 times as much as the silicone oil (specific gravity at about 1.0 g/cc).

(Spray Amount)

2 cc/min

In this case, the size of an area on the surface of the canvas against which a paper strip is pressed was 90 $m^2$ and a supply rate of the silicone oil for a unit area per a unit time was:

$$2\ \text{cc/min} \times \text{log/cc} \div 14 \div 90\ \text{m}^2 = 1.6 \times 10^{-3}\ \text{g/m}^2\ \text{per min} = 1.6\ \text{mg/m}^2\ \text{per min.}$$

(Result)

The result showed that no clogging of the eyes of the canvas was observed at all, and neither transfer of the contaminant to the surface of paper nor adhesion of the silicone oil thereto was observed.

Further, breaks of paper occurred 6 times in the dry part during the test, representing a marked reduction in frequency of occurrence of the breaks in comparison with that experienced before application of the technology of the invention, which was 20 times per month.

With reference to the embodiments described in the foregoing, there were two different cases wherein the surface treatment agent was sprayed through the nozzle/nozzles. In one case, water used for dilution of the surface treatment agent was heated up to 50 to 80° C. immediately before spraying while in the other case, water used for dilution of the surface treatment agent remained at room temperature (on the order of 23° C.).

Test results showed that in the case of using water at room temperature, the nozzle was clogged up frequently (once a week or once every other week) while in the case of using water heated up, no clogging of the nozzle occurred at all, enabling efficient spraying to be carried out.

COMPARATIVE EXAMPLE 1

With the multiple drum-dryer type paper machine shown in FIG. 1, a test was carried out for a month, using a canvas with antifouling treatment applied thereto by use of a water repellant (Teflon), and thereafter, the surface condition of the canvas was observed.

Also, data were gathered on the surface condition of paper (corrugating medium material) produced during the test and frequency of occurrence of downtimes during operation, caused by breaks of paper.

(Result)

Figure 13:
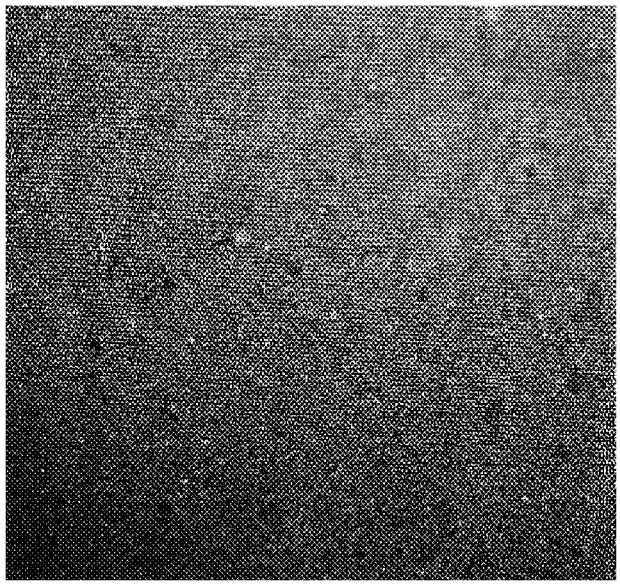
FIG. 13 is a photograph showing the result of a comparative example 1.
Figure 14:
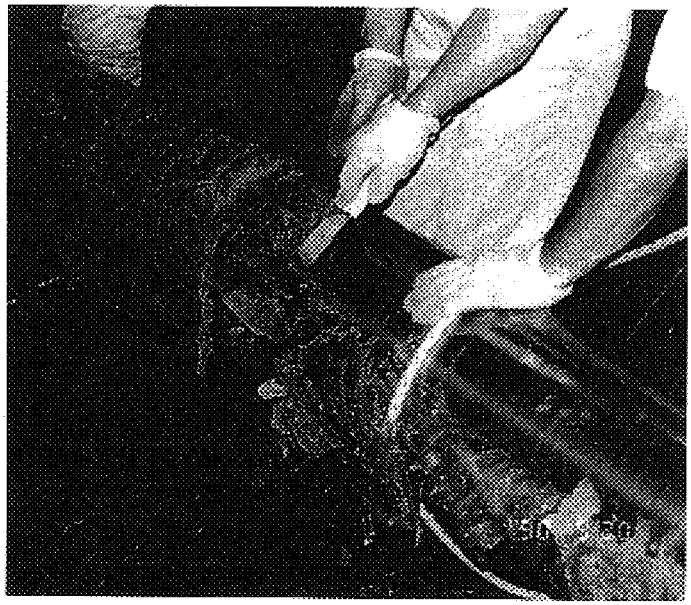
FIG. 14 is a photograph showing the result of a comparative example 2.

The result showed that the eyes of the canvas, in a number of parts thereof, were found clogged with adhesive material (refer to FIG. 14) and similar adhesive material in lumps were found accumulated on the surface of the outrolls (refer to FIG. 13). Also, much adhesive material such as pitch, paper powders, and so forth were observed on the surface of paper.

During the test, product paper of poor quality due to adhesion of pitch, paper powders, and so forth was produced 23 times, and breaks of paper occurred 42 times.

COMPARATIVE EXAMPLE 2

After tests were carried out under the same conditions as for the embodiment 1 for a month, the surface condition of the canvas at that point in time was observed (observation 1).

While increasing a spray amount of the surface treatment agent 2.5-fold, 5-fold, 7.5-fold, 10-fold, and 12.5-fold, respectively, every five hours, the surface condition of the canvas was observed, and the quality of paper (liner) produced during the test was also inspected (observation 2).

(Spray Amount)

15, 30, 45, 60, and 75 cc per min, respectively (Supply Rate Of The Silicone Oil)

50, 100, 150, 200, and 250 mg/m$^2$ per min, respectively (Result)

The result shored that upon observation 2 when a spray amount was at 30 cc per min (the silicone oil supply rate at 100 mg/m$^2$ per min), a trace of contaminant found adhered to the surface of the canvas upon observation 1 was found substantially disappeared.

When a spray amount was further increased, no change in the surface condition of the canvas resulted, however, it was found that at a spray amount of 75 cc per min (at a silicone oil supply rate of 250 mg/m$^2$ per min), dripping of the surface treatment agent in excess from the canvas occurred, causing the eyes of the canvas to start clogging, and the periphery of the canvas to become slippery with the silicone oil. Thus, a test operation was thrown into a dangerous state.

COMPARATIVE EXAMPLE 3

After a test was carried out under the same conditions as for the embodiment 3, the surface condition of the canvas at that point in time was observed (observation 1).

By decreasing an amount (in weight) of the silicone oil contained in the surface treatment agent by half, one quarter, one eighth, one tenth, and one twentieth, respectively, every five hours, while keeping a spray amount of the surface treatment agent at a constant level, the surface condition of the canvas was observed, and the quality of paper (low grade printing paper) produced during the test was also inspected (observation 2).

(Spray Amount)

2 cc/min (Supply Rate of the Silicone Oil)

0.8, 0,4, 0.2, 0.16, and 0.08 mg/m$^2$ per min, respectively (Result)

The result showed that in comparison with the surface condition of the canvas upon observation 1, an amount of the contaminant found adhered to the surface of the canvas gradually increased upon observation 2 according as the supply rate was decreased, however, until the supply rate was decreased to 0.16, mg/m$^2$ per min, there was observed no adverse effect on paper without causing clogging of the eyes of the canvas.

When the supply rate was decreased to as low as 0.08 mg/m$^2$ per min, however, there was observed a sudden increase in an amount of the contaminant adhered to the surface of the canvas, causing clogging of the eyes of the canvas to start with the result that the contaminated canvas came to cause adverse effects on paper.

Figure 15:
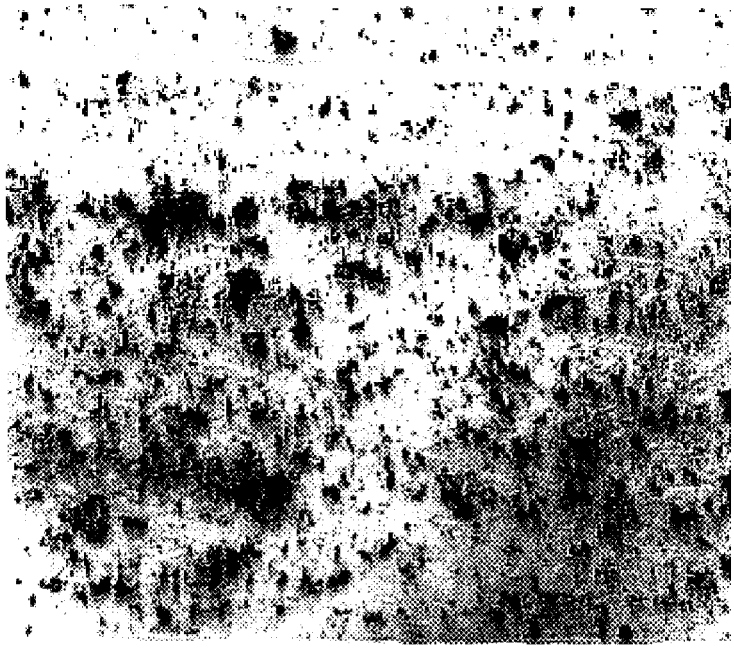
FIG. 15 is a photograph showing the result of a comparative example 3.

For comparison of the result of the embodiment 1 with that of the comparative example 3 (the supply rate of the silicone oil at 0.8 mg/m$^2$ per min), operation of the paper machine was stopped, and the constituents of the contaminant were sampled by applying a polyester adhesive tape (5 cm in width) to the surface of the canvas. FIG. 15 shows the result of such comparison.

Now, the method of the invention described hereinbefore relates to the method of supplying the surface treatment agent directly onto the surface of the canvas.

The invention, however, provides an alternative method of supplying the surface treatment agent indirectly onto the surface of the canvas other than the method of supplying the surface treatment agent directly onto the surface of the canvas.

Figure 8:
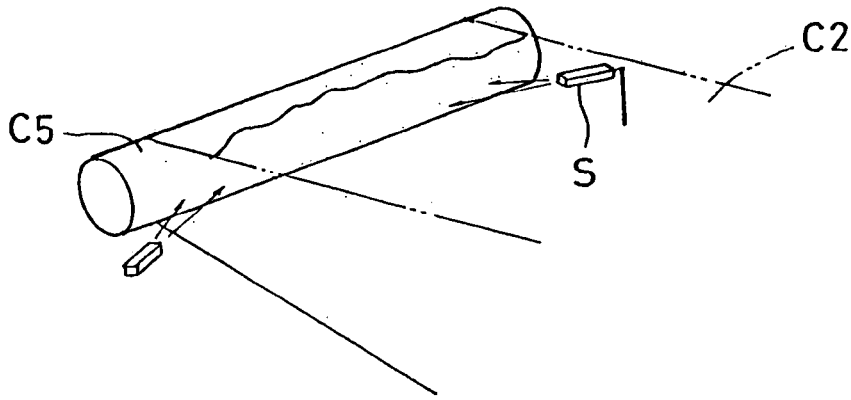
FIG. 8 is a view showing a state of spraying the surface treatment agent onto the surface of an out-roll of the paper machine through the fixed type spray nozzles of the chemical spray unit.

FIG. 8 shows a method of supplying a surface treatment agent indirectly onto the surface of the canvas by way of example, and particularly in this case, an example wherein the surface treatment agent is sprayed onto an outroll in a pulled-back position is shown.

Figure 9:
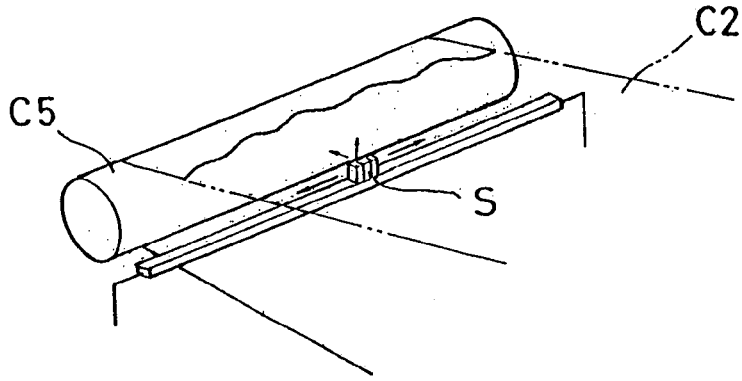
FIG. 9 is a view showing a state of spraying the surface treatment agent onto the surface of an out-roll of the paper machine through the movable type spray nozzle.

As shown in the figure, a surface treatment agent containing the silicone oil is sprayed onto the surface of the outroll through spray nozzles (fixed type) of the chemical spray unit FIG. 9 is a view showing an example wherein the surface treatment agent is sprayed onto the surface of the outroll through a movable type spray nozzle of the chemical spray unit.

Figure 10:
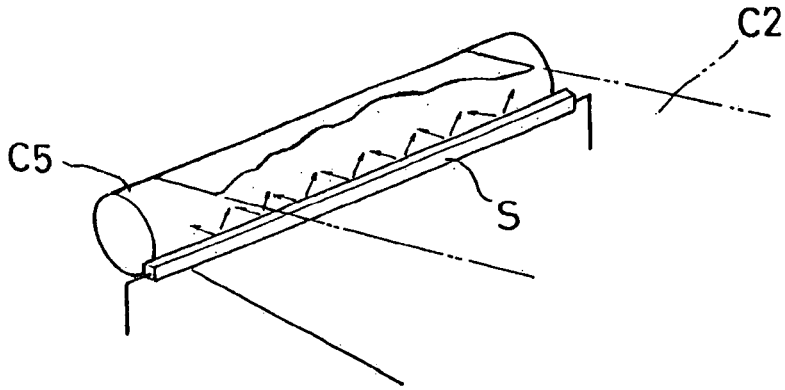
FIG. 10 is a view showing a state of spraying the surface treatment agent onto the surface of an out-roll of the paper machine through the spray nozzles disposed lengthwise.

FIG. 10 is a view showing an example wherein the surface treatment agent is sprayed onto the surface of the outroll using the chemical spray unit provided with spray nozzles disposed lengthwise.

In the examples described above, an advantage of preventing scattering of the surface treatment agent is gained by applying spraying to the outroll C5 disposed in a pulled-back position (position indicated by the letter Z in FIG. 2) because a narrow space formed between the top side and the underside of the outroll C5 can be isolated by a canvas C2.

Now, a series of steps for supplying the surface treatment agent containing the silicone oil indirectly, or onto the surface of the outroll will be described hereinafter.

1) Silicone Oil Supply Step

The silicone oil P is adhered to the surface of the outroll.

2) Silicone Oil Shifting Step

The silicone oil P is shifted from the surface of the outroll to the canvas C2, and as a result, the silicone oil P is adhered to the surface of the canvas.

Succeeding steps thereafter are the same as those for the method of supplying the surface treatment agent directly to the canvas as described in the foregoing.

Thus, respective operations described above are caused to come into play when the process of treatment goes through each of the five steps, that is, the silicone oil supply step, the silicone oil shifting step, the silicone oil permeation and adhesion step, the silicone oil transfer step, and the silicone oil replenishment step, thereby developing antifouling effects on the canvases.

While the preferred embodiments of the invention have been described in the foregoing, it is to be understood that the scope of the invention is not limited thereto, and various other modifications may be made without departing from the spirit or scope of the invention.

For example, a position where spraying is made is selectable optionally within the paper machine as long as the position will not interfere with the operation of the paper machine.

The same may be said of the outrolls.

INDUSTRIAL APPLICABILITY

Although the invention is a canvas used in conjunction with dryers of a paper machine, it can be utilized in the entire technical field for manufacturing paper which is expected to have the same effect as the invention.

What is claimed is:

1. A method of preventing contamination of a canvas for pressing a paper strip against a surface of drum-dryers used for drying the paper strip in a paper machine, whereby a silicone oil is emulsified with a surfactant, said emulsified silicone oil is diluted with water immediately before spraying, said water being heated to a temperature in the range of 50 to 80° C., and said diluted silicone oil is then continuously supplied at a spray rate of 0.1 to 200 mg/m$^2$ per minute to a surface of canvas rolls for guiding the canvas, in a stage of operation prior to the paper strip being pressed into contact with the canvas as well as the drum-dryers, while the paper strip is being fed by operation of the paper machine.

2. A method of preventing contamination of a canvas for pressing a paper strip against a surface of drum-dryers used for drying the paper strip in a paper machine, said method comprising the following steps 1) to 7):

1) emulsifying a silicone oil with a surfactant;
2) diluting said silicone oil with water immediately before it is supplied to a surface of an out-roll, said water being heated to a temperature in the range of 50 to 80° C.;
3) supplying said silicone oil to the surface of the out-roll at a spray rate of 0.1 to 200 mg/m$^2$ per minute;
4) shifting the silicone oil from the surface of the out-roll to the canvas;
5) causing the silicone oil to permeate through the canvas and adhere to the surface thereof under heat and pressure;
6) pressing a paper strip against the canvas, causing the silicone oil to be transferred to the paper strip; and
7) replenishing the silicone oil depleted after transferred from the canvas.

* * * * *